US005609176A

United States Patent [19]

Weeks

[11] Patent Number: 5,609,176

[45] Date of Patent: Mar. 11, 1997

[54] COMBINATION WALKING STICK AND BLIND

[76] Inventor: Casey M. Weeks, HC 86 Box 9AA, Sicily Island, La. 71368

[21] Appl. No.: 369,353

[22] Filed: Jan. 6, 1995

[51] Int. Cl.[6] ..... A45B 3/00; A45F 4/00

[52] U.S. Cl. ..... 135/96; 135/66; 135/74; 135/901; 135/117; 135/126; 135/132

[58] Field of Search ..... 135/96, 66, 74, 135/77, 901, 903, 913, 87, 117, 118, 114, 95, 126, 132, 133, 115, 119

[56] References Cited

U.S. PATENT DOCUMENTS

| | | | |
|---|---|---|---|
| 1,415,482 | 5/1922 | Reed . | |
| 2,771,088 | 11/1956 | Soldan | 135/87 |
| 2,777,454 | 1/1957 | Kramer | 135/87 |
| 2,783,766 | 3/1957 | Kohlbeck | 135/1 |
| 2,980,124 | 4/1961 | Atchison | 135/901 X |
| 3,487,842 | 1/1970 | Larkin et al. | 135/903 X |
| 3,537,688 | 11/1970 | Stein | 256/24 |
| 3,642,318 | 2/1972 | Avant | 297/184 |
| 3,799,608 | 3/1974 | Smutny et al. | 297/184 |
| 3,902,264 | 9/1975 | Radig | 43/1 |
| 4,473,087 | 9/1984 | Cavender | 135/87 |
| 4,685,484 | 8/1987 | Moneta | 135/117 |
| 4,773,437 | 9/1988 | Glutting | 135/901 X |
| 4,825,891 | 5/1989 | Machado | 135/117 X |
| 4,860,777 | 8/1989 | Orlando | 135/87 |
| 4,960,144 | 10/1990 | Wheatley et al. | 135/117 X |
| 4,966,181 | 10/1990 | Liberman | 135/87 |
| 5,010,909 | 4/1991 | Cleveland | 135/901 |
| 5,062,234 | 11/1991 | Green | 43/1 |
| 5,414,950 | 5/1995 | Johnson, Sr. | 135/901 X |

FOREIGN PATENT DOCUMENTS

| | | | |
|---|---|---|---|
| 0654505 | 12/1962 | Canada | 135/901 |

*Primary Examiner*—Wynn Wood
*Attorney, Agent, or Firm*—John M. Harrison

[57] ABSTRACT

A combination walking stick and blind which includes a bi-support blind characterized by a pair of longitudinally half-round, elongated supports pivotally joined at one end, with the flat sides of the supports positioned in facing relationship and the supports fitted with camouflage netting or fabric designed to deploy when the bottoms of the supports are extended in pivoted relationship, and wrapped around the supports when and the supports are aligned, to define a walking stick. In another embodiment three supports define a tri-support blind, which supports may be configured as one-third-round supports that nest when joined together to define a walking stick. Camouflage netting or fabric is attached to the supports by means of looped securing straps. In another aspect of the tri-support blind, the supports may be characterized by two longitudinally half-round supports and one support having a rectangular cross-section, that longitudinally nest to define a walking stick having an ellipitical cross-section when the camouflage netting or fabric is wrapped on the composite supports. In another embodiment, four such supports define a quad-support blind, two of which supports include longitudinally half-round, elongated supports and the other two supports having a rectangular cross-section. The supports may be nested together and the camouflage netting or fabric wrapped around the supports to define a walking stick. Finally, the four supports may include longitudinally quarter-round supports which nest to define a walking stick having a circular cross-section.

20 Claims, 2 Drawing Sheets

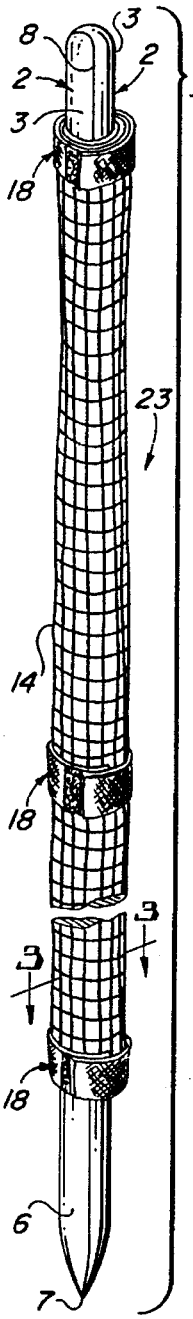
FIG. 1
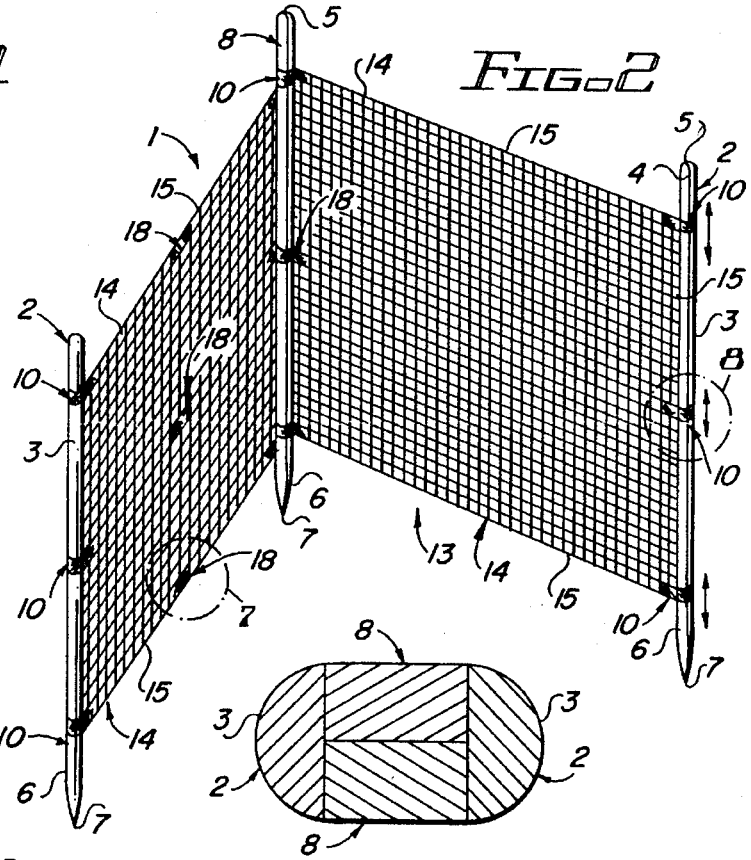
FIG. 2
FIG. 5A
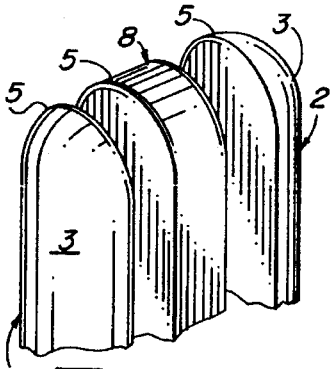
FIG. 4
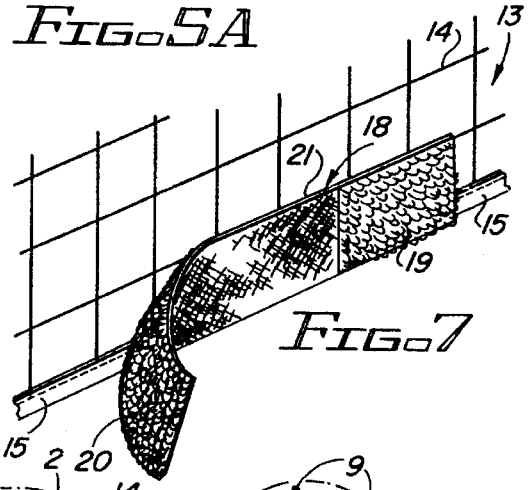
FIG. 7
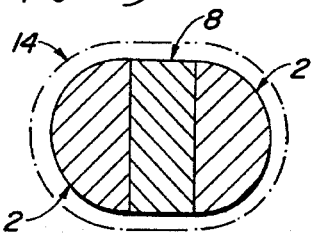
FIG. 3
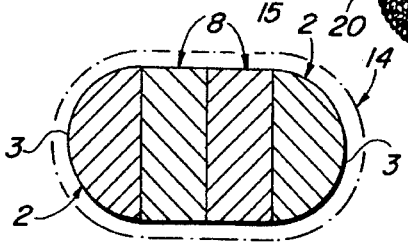
FIG. 5
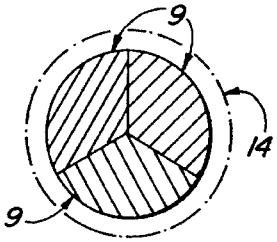
FIG. 6

COMBINATION WALKING STICK AND BLIND

BACKGROUND OF THE INVENTION

1. Field of the Invention

This invention relates to hiking and hunting and more particularly, to a combination walking stick and blind which is typically characterized by a bi-support blind, a tri-support blind and a quad-support blind. In a preferred embodiment, the bi-support blind is characterized by a pair of longitudinally half-round, elongated supports pivoted at a grip end and fitted with a shaped, flexible camouflage netting or fabric panel having a desired camouflage pattern, such as the "TREBARK"™ or "REAL TREE"™ camouflage pattern, in non-exclusive particular and a securing strap extending from the bottom netting margin of the camouflage netting or fabric panel. Accordingly, the bi-support blind can be deployed by extending the non-pivoted, ground-engaging, tapered ends of the half-round supports outwardly to stretch the camouflage netting or fabric panel in a triangular configuration and the sharpened points of the half-round supports may be forced into the ground to provide the desired camouflage. The half-round supports can be re-pivoted into alignment along the flat edges thereof and the camouflage netting or fabric panel wrapped around the composite support and secured by the securing strap, to facilitate use of the bi-support blind as a walking stick.

In another preferred embodiment of the invention, a tri-support blind is provided wherein three elongated supports having essentially triangular-shaped cross-sections which nest or fit together longitudinally to define a composite support having a circular cross-section, are provided and a camouflage netting or fabric panel is secured to each of the supports by means of elastic support mount loops, straps or ties to facilitate slidable adjustment of the camouflage netting or fabric panel with respect to the respective supports. Alternatively, the supports can be characterized by two longitudinally half-round elongated members, with an elongated support having a rectangular cross-section sandwiched between the half-round members to enhance the rigidity of the composite support in walking stick configuration. Loop-pile securing straps are attached to one of the segments of the camouflage netting or panel for securing the camouflage netting or fabric panel in wrapped configuration around the nested supports.

In yet another preferred embodiment of the invention, a quad-support blind is provided, with four elongated supports which may, in one aspect, be characterized by a longitudinal quarter-round configuration in which the supports nest together to define a round composite walking stick, with a length of camouflage netting or fabric panel connected to the supports. Alternatively, the four elongated supports may be characterized by a pair of half-round members and a pair of elongated members having rectangular cross-sections arranged between the half-round supports, either longitudinally or laterally, to define a generally elliptically-shaped walking stick. As in the case of the tri-support blind, the camouflage netting or fabric panel in the quad-support blind may be attached to the respective elongated supports by means of elastic support mount loops, straps or ties to facilitate slidably positioning the camouflage netting or fabric panel on the respective supports. Deployment of both the tri-support blind and the quad-support blind includes spacing the respective supports to stretch the camouflage netting or fabric panel between the supports and driving the sharpened ground-engaging ends of the supports into the ground in a desired configuration. The supports and camouflage netting are deployed into walking stick configuration by initially joining the supports into the longitudinally nested composite configuration described above, wrapping the camouflage netting around the composite supports and securing the netting in position by means of loop-pile securing straps.

One of the problems associated with hunting various types of game, including deer, elk, turkey and the like, is that of concealment, particularly under circumstances where there is little or no natural cover in the hunting area. Typical hunting stands and blinds include platforms mounted in trees, triangular-shaped, portable tripod stands having a rotatable, saddle-type seat at the top and large, cumbersome, portable stands constructed of plywood or cardboard, which are difficult to transport, deploy and use effectively. Furthermore, since wild game typically have very sharp eyesight and are sensitive to even small movements, the use of camouflage clothing alone is sometimes insufficient to facilitate close approach by the game. Moreover, a close approach by wildlife to the hunter is particularly necessary during bow and arrow hunting and in the case of wildlife observation and photography, additional cover, whether natural or artificial, is usually necessary to faciliate a sufficiently close approach by wild animals and birds.

2. Description of the Prior Art

Various types of collapsible shelters, blinds and other structures are known in the art. U.S. Pat. No. 1,415,482, dated May 9, 1922, to R. T. Reed, details a "Collapsible Tent" which is constructed somewhat like a teepee, with a frame of flexible fabric covering the frame, wherein the frame is secured at the top to facilitate folding of the frame inwardly and wrapping of the fabric around the frame when the frame is in folded configuration. A "Collapsible Sportman's Hut and Duck Blind" is detailed in U.S. Pat. No. 2,783,766, dated Mar. 5, 1957, to C. A. Kohlbeck. The device is also shaped generally in the configuration of a teepee, with multiple supports attached to the top by means of a rope and fitted with a flexible fabric outer covering. The entire structure can be folded inwardly and carried to various locations when moved. A "Convertible Windbreak" is detailed in U.S. Pat. No. 3,537,688, to B. Stein. The windbreak includes a rectangular strip of fabric having grommets at the corners and along the top and bottom edges thereof and multiple, elongated stakes fitted with hooks for engaging the grommets and deploying the windbreak in position to block the wind. U.S. Pat. No. 3,642,318, dated Feb. 15, 1972, to Ralph L. Avant, details a "Hunter's Blind". The blind includes a collapsible structure having hinged elements that are covered with a flexible material which may include a camouflage pattern. The device also includes an adjustable seat. U.S. Pat. No. 3,799,608, dated Mar. 26, 1974, to Frank D. Smutny, details a "Portable Blind" having a collapsible frame with a folding seat. The lower portion of the frame is covered with a camouflage material, while the upper part of the frame is covered with a net-like material that permits the hunter to see outside the blind. The lower camouflage material includes a pair of front flap members having registering grommets and the net-like material includes a movable top portion having an elastic band for moving the top portion from a closed position to an open position and allowing the hunter to stand up in the blind for shooting purposes. An arcuate hook element is mounted on the lower forward end of the top portion of the net-like material and is extended through the registering grommets for selectively maintaining the blind in a closed position.

U.S. Pat. No. 3,902,264, dated Sep. 2, 1975, to Theodore N. Radig, details a "Blind For Hunters and the Like". The blind is portable and includes a frame structure having a ground-engaging, portable base. A collapsible shroud is carried by the frame to present a concealment cover and the frame structure includes multiple shroud-supporting elements, of which at least two define a forward pair of elements hinged for movement about the vertical axis. A shiftable positioner mechanism is carried by the frame structure for positioning and releasably holding the forward elements in the first relative disposition presenting the cover and includes means for causing the two forward elements to swing to a second relative disposition partially collapsing the cover, to present an opening and affording an unobstructed forward field of view. A "Wind Shelter" is detailed in U.S. Pat. No. 4,685,484, dated Aug. 11, 1987, to Ted C. Moneta. The wind shelter includes an arm mechanism which urges arm segments interconnecting adjacent posts into a horizontal aligned and opposing position when the wind shelter is in use. The arm mechanism also urges the arm segments toward a position in which they are contiguous along their lengths when the wind shelter is collapsed, for transportation. The fabric of the wind shelter has parallel pockets for receiving posts and an upper flap portion for removably attaching the fabric to the post. U.S. Pat. No. 4,860,777, dated Aug. 29, 1989, to Anthony Orlando, details a "Combination Beach Blanket and Wind Protector Device". The device includes a flexible mat that is movable from a rolled-up, closed, carried configuration to a flat, open configuration wherein the mat is disposed in a substantially horizontal position on a selected ground site. Side and head panels are joined to the mat along fold lines and multiple openings are located in the mat in spaced relationship with respect to the side and head panels. Multiple posts are provided, each of which extends through an opening in the mat for penetration into the ground and fixing the mat in the flat, open position thereon. A first fastening element is joined to the side and head panels and a second fastening element is secured to the post, such that the first and second fastening elements cooperate for mounting the side and head panels on the post, thus locating the side and head panels in an upright position for sheltering an occupant who is lying on the mat. A "Beach Wind-Shielding and Signaling Device" is detailed in U.S. Pat. No. 4,966,181, dated Oct. 30, 1990, to Michael Liberman, et al. The device includes a rectangular fabric article vertically supported on poles on a beach, so that users on the leeward side are shielded from the wind. The device has a color indicia or the like imprinted on the windward side to serve as a location-indicating visual signal. U.S. Pat. No. 5,010,909, dated Apr. 30, 1991, to Thomas J. Cleveland, details a "Knock-Down Deer Blind". The device includes a three-dimensional, rectangular frame provided with an upstanding, flexible sleeve which engages the frame. The lower end of the sleeve may be opened and closed for ingress and egress to the blind and the upper and lower ends of the sleeve include upwardly-directed marginal flaps extending over and under, respectively, the upper and lower ends of the frame. The sleeve is constructed of a material which may have a camouflage design on its outer surface and which is preferably substantially air-impervious. A "Portable Blind" is detailed in U.S. Pat. No. 5,062,234, dated Nov. 5, 1991, to Richard T. Green. The blind includes a length of camouflage material provided with a desired camouflage pattern, which material is stretched between multiple supports embedded in the ground to define discreet panels and conceal a hunter or observer. A camouflage material can be fitted with a drawstring around the top edge thereof and is characterized by cloth or netting. In a most preferred embodiment the elongated supports include a bottom member, a receptacle fitted to the top end of the bottom member for receiving the bottom end of a corresponding top member and an elastic band connecting the bottom end of the top member to the top end of the bottom member. Alternatively, the bottom member may be telescoped into the top member to disassemble the blind and extended from the bottom member to deploy the blind.

It is an object of this invention to provide a portable, lightweight blind which may be carried or used as a walking stick when in non-deployed configuration and operates to facilitate adequate camouflage when in deployed configuration.

Another object of this invention is to provide a portable combination walking stick and blind which is characterized by two or more elongated, longitudinally-nesting supports fitted with a camouflage panel or netting for nesting as a composite to define a walking stick and deployment to stretch the camouflage panel or netting between the supports when used as a blind to conceal a hunter or observer.

Yet another object of this invention is to provide a new and improved bi-support blind characterized by a pair of elongated, longitudinally half-round supports having sharpened ends and pivotally attached at the opposite grip ends from the sharpened ends, with a camouflage netting or fabric panel deployed on the supports such that the supports may be pivotally aligned along facing flat edges and the camouflage netting or fabric panel wrapped around the supports to define a composite support walking stick, and deployed by pivoting the supports to extend the sharpened ends away from each other and stretch the camouflage netting or fabric panel between the supports for use as a blind to conceal the hunter or observer.

Still another object of this invention is to provide a tri-support blind which is characterized by three elongated supports that may have pointed ends and substantially triangular cross-sectional configurations to define a longitudinally nested, composite walking stick configuration, with a camouflage netting or fabric panel connecting the supports, such that supports may be nested together and the camouflage netting wrapped around the supports and secured in place to define a walking stick and the supports may be alternatively deployed in spaced relationship with respect to each other by driving the pointed ends in the ground and stretching the camouflage netting or panels between the supports to define a blind for concealing the hunter or observer. Alternatively, two of the supports may be characterized by half-round supports, with the third support having a rectangular cross-sectional configuration, such that the third support is nested between the flat sides of the first two supports when the supports are deployed in composite walking stick configuration.

A still further object of the invention is to provide a quad-support blind characterized by four pointed, elongated supports, two of which may be half-round in longitudinal configuration and the other two having rectangular cross-sectional configurations, with a camouflage netting or fabric panel attached to the supports. Accordingly, the supports can be longitudinally nested together, with the two supports having a rectangular cross-sectional configuration nested either laterally or longitudinally between the flat sides of the two half-round supports, to generally define an elliptical shaped composite walking stick, with the camouflage netting or fabric panel wrapped around the walking stick and secured in place. The supports can correspondingly be deployed to define a hunter's or observer's blind by extending the supports in spaced relationship with respect to each other and driving the sharp ends thereof into the ground in a desired configuration to stretch the camouflage netting or fabric panels between the supports.

These and other objects of the invention are provided in new and improved portable combination walking sticks and blinds which are characterized by two or more elongated supports of desired matching and nesting cross-sectional configuration to facilitate longitudinal nesting or fitting together to define a walking stick having connecting camouflage netting or fabric. The camouflage netting or fabric may be wrapped around the composite supports when the supports are nested in walking stick configuration or extended between the supports when the supports are driven into the ground to define the blind.

BRIEF DESCRIPTION OF THE DRAWINGS

The invention will be better understood by reference to the accompanying drawings, wherein:

FIG. 1 is a perspective view of a preferred embodiment of a tri-support blind of this invention, with the three supports nested and wrapped with the camouflage netting in walking stick configuration;

FIG. 2 is a perspective view of the tri-support blind illustrated in FIG. 1, deployed in functional blind configuration;

FIG. 3 is a sectional view of a first preferred longitudinal nesting configuration for the three supports in the tri-support blind illustrated in FIGS. 1 and 2;

FIG. 4 is an exploded view, partially in section, of the grip end of the three supports in the tri-support blind illustrated in FIGS. 1 and 2, more particularly illustrating the preferred nesting configuration of the walking stick illustrated in FIG. 1;

FIG. 5 is a sectional view of a preferred longitudinal nested support configuration for a quad support blind of this invention;

FIG. 5A is an alternative preferred longitudinal nested support configuration for the four supports in the quad support blind of this invention;

FIG. 6 is a sectional view of an alternative preferred nested configuration for the three elongated supports used in the tri-support blind illustrated in FIGS. 1 and 2;

FIG. 7 is an enlarged perspective view, partially in section, of a typical securing strap for securing the camouflage netting around the nested supports to define the walking stick illustrated in FIG. 1;

DESCRIPTION OF THE PREFERRED EMBODIMENTS

Figure 8:
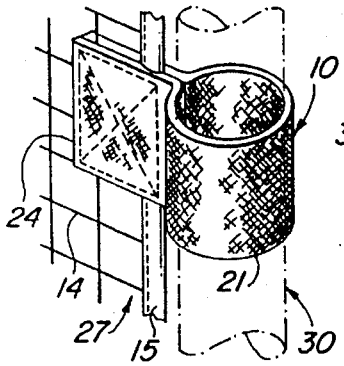
FIG. 8 is an enlarged perspective view, partially in section, of a typical support mount loop, strap or tie used in the tri-support blind and quad-support blinds of this invention to slidably connect the camouflage netting to respective elongated supports.

Referring initially to FIGS. 1–4, 6 and 8 of the drawings, in a first preferred embodiment the tri-support blind of this invention is generally illustrated by reference numeral 1. The tri-support blind 1 is supported by a pair of longitudinally half-round supports 2 in combination with a third rectangular support 8 which may be nested as illustrated in FIGS. 1 and 4 to define a cross-section illustrated in FIG. 3. Alternatively, the supports may be characterized by generally triangular-shaped supports 9 having a circular cross-section when nested, as illustrated in FIG. 6. In each case, a tri-support camouflage 13 is attached to the half-round supports 2 and the rectangular support 8 or to each of the triangular supports 9 by means of spaced, elastic support mount loops 10, as illustrated in FIGS. 2 and 8. Accordingly, it will be appreciated from a consideration of FIGS. 1 and 2 of the drawings that the tri-support blind 1 may be deployed in functional configuration to conceal a hunter or observer as illustrated in FIG. 2, with the respective half-round supports 2 and rectangular support 8 or the three triangular supports 9 extended in a generally triangular configuration to drive the tapered ground-engaging ends 6, sharpened to a point 7, into the ground to support the tri-support blind 1. The opposite blunt, grip ends 5 of the half-round supports 2, rectangular support 8 or the three triangular supports 9, project upwardly substantially vertically with respect to the supporting surface or ground, with the camouflage netting 14 stretched between the respective supports such that the top and bottom netting margins 15 are positioned substantially parallel to the supporting surface. Since the elastic support mount loops 10 are looped around the respective half-round supports 2 and rectangular support 8 or the three triangular supports 9 and sewn, glued or otherwise attached to the one-piece camouflage netting 14 as illustrated in FIG. 8, the entire camouflage netting 14 may be adjusted upwardly or downwardly on the respective supports as desired, to optimize concealment by the camouflage netting 14. When it is desired to deploy the tri-support blind 1 into the walking stick 23 configuration illustrated in FIG. 1, the half-round supports 2 and rectangular support 8 or the triangular supports 9 are removed from the ground and placed together in nested configuration with the flat surfaces 4 facing each other and the rounded surfaces 3 facing outwardly, as illustrated in FIGS. 3 and 6, respectively. The camouflage netting 14 of the tri-support camouflage 13 is then wrapped around the composite support and the securing straps 18, which includes loop elements 19 and pile elements 20, sewn or otherwise attached to opposite sides of an elastic segment 21, and having one end sewn, glued or otherwise attached to the camouflage netting 14, are wrapped around the entire camouflage netting and support composite as illustrated in FIG. 1 to secure the camouflage netting 14 in place.

Figure 9:
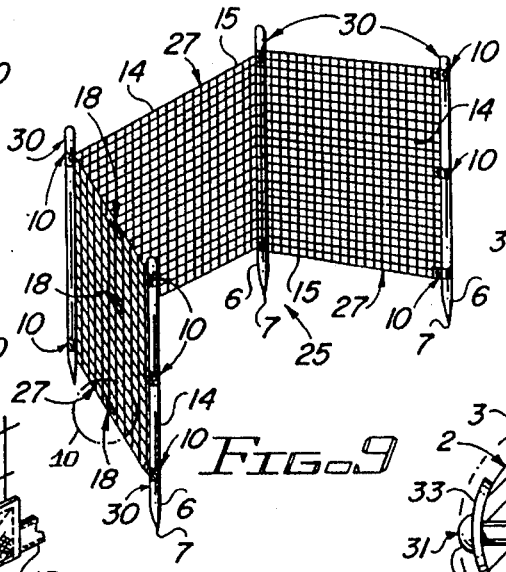
FIG. 9 is a perspective view of the quad support blind of this invention in deployed configuration to conceal a hunter or observer.
Figure 11:
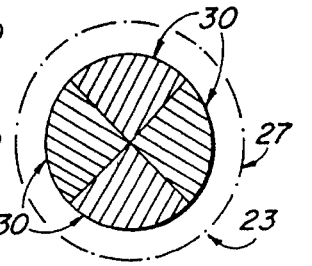
FIG. 11 is a sectional view of a preferred longitudinally nested configuration for the four supports in the quad support blind illustrated in FIG. 9 when the blind is deployed in walking stick configuration.
Figure 10:
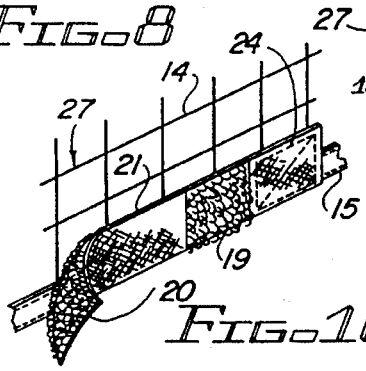
FIG. 10 is an enlarged perspective view of an alternative preferred securing strap for securing the camouflage netting in position on the nested supports in walking stick configuration as illustrated in FIG. 1.

Referring now to FIGS. 5–11 of the drawings, a quad-support blind 25 is illustrated with four rectangular supports 26, two of which are characterized by half-round supports 2 and the other two by rectangular supports 8. As in the case of the half-round supports illustrated in FIGS. 1–4, the half-round supports 2 used in the deployment of the quad-support blind 25 include a flat longitudinal surface 4 and a rounded longitudinal surface 3. Furthermore, the rectangular supports 8 may be deployed either laterally or longitudinally between the half-round supports 2, as illustrated in FIGS. 5 and 5A, when the half-round supports 2 and rectangular supports 8 are configured in the walking stick configuration 23 as illustrated with respect to the tri-support blind illustrated in FIG. 1. Accordingly, the quad-support blind 25 may be deployed as illustrated in FIG. 9 when it is desired to conceal the hunter or observer with the tapered, ground-engaging ends 6 of the half-round supports 2 and rectangular supports 8 extended into the ground at the points 7 and the quad-support camouflage 27 deployed on the half-round supports 2 and rectangular supports 8 by means of the support mount loops 10, in the same manner as that illustrated with respect to the tri-support blind 1 illustrated in FIG. 2. Accordingly, as in the case of the tri-support blind 1 illustrated in FIG. 2, the one-piece panel of camouflage netting 14 of the quad-support camouflage 27 may be adjusted upwardly or downwardly on the half-round supports 2 and the rectangular supports 8, as desired, to provide optimum concealment for the hunter or observer using the quad-support blind 25. It will be further appreciated that the quad-support blind 25 may be deployed into the walking stick configuration 23 in the same manner as illustrated in FIG. 1 with respect to the tri-support blind 1, by initially joining the half-round supports 2 and the rectangular supports 8 in the longitudinally nested configuration illustrated in FIGS. 5 or 5A and subsequently wrapping the camouflage netting 14 of the quad-support camouflage 27 around the nested, composite half-round supports 2 and rectangular supports 8 as illustrated in FIG. 1. The securing straps 18 attached along the centerline of one panel of the camouflage netting 14 located between one of the half-round supports 2 and one of the rectangular supports 8 as illustrated in FIG. 9 are then used to secure the camouflage netting 14 in position on the nested half-round supports 2, as further illustrated in FIG. 1.

Figure 13:
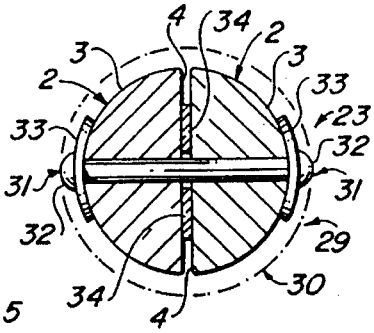
FIG. 13 is a sectional view taken along line 13—13 of the bi-support blind illustrated in FIG. 12, more particularly illustrating a preferred pivoting connection of the top, or grip ends of the half-round supports in the bi-support blind.
Figure 12:
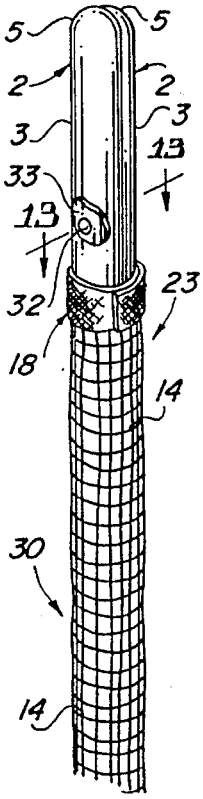
FIG. 12 is a perspective view, partially in section, of a bi-support blind pivoted into walking stick configuration with camouflage netting wrapped around the two aligned, elongated supports.
Figure 14:
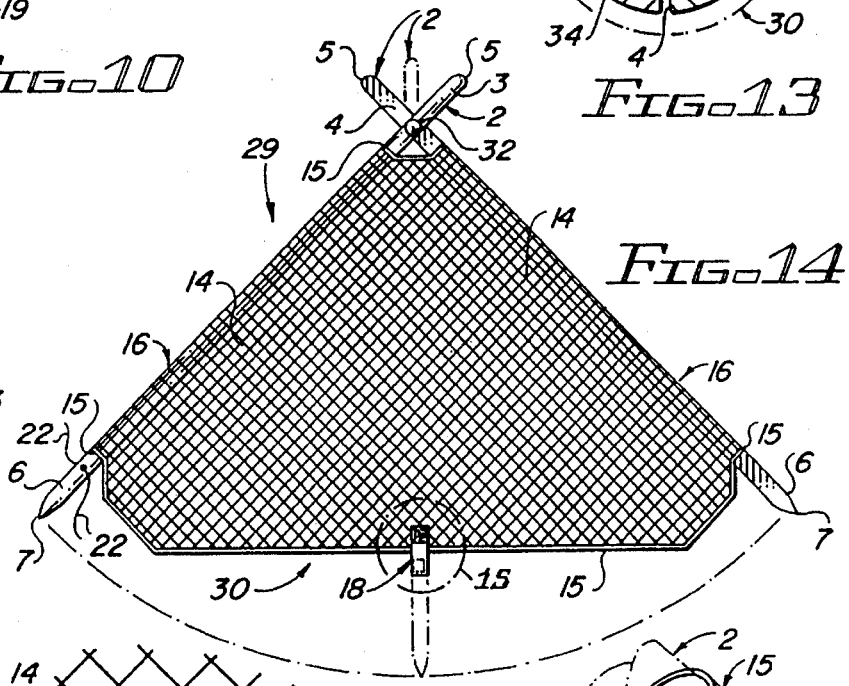
FIG. 14 is a front elevation of the bi-support blind illustrated in FIG. 12 in deployed configuration with the half-round supports extended at the bottom and pivoted at the top to deploy the camouflage netting.
Figure 15:
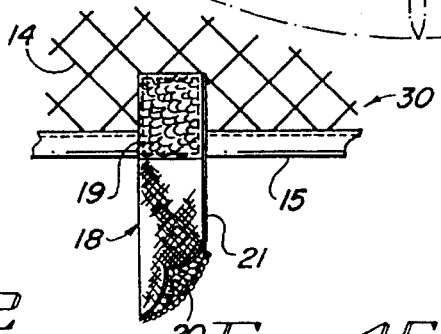
FIG. 15 is an enlarged perspective view of a typical securing strap attached to the bottom margin of the camouflage netting in the bi-support blind illustrated in FIG. 14.
Figure 16:
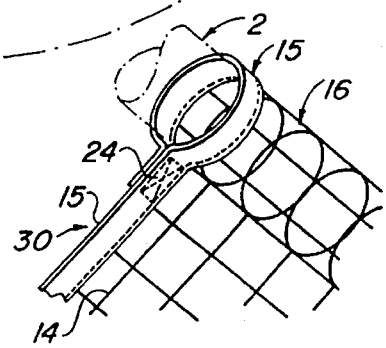
FIG. 16 is an enlarged perspective view of a typical netting sleeve for slidably mounting the support netting on the half-round supports of the bi-support blind illustrated in FIG. 14.

Referring now to FIGS. 12–16 of the drawings, in another preferred embodiment of the invention a bi-support blind 29 is provided, wherein a pair of longitudinally half-round supports 2 are pivotally attached at one end by means of a pivot pin or brad 31 having a brad shaft 31*a* and a head 32 at each end, supported by a pair of arcuate pin plates 33, as illustrated in FIG. 13. The curved or arcuate pin plates 33 serve to stabilize the head 32 on each side of the pivot pin or brad 31 and prevent the heads 32 from pulling through the half-round supports 2, which may be constructed of wood. Furthermore, in a most preferred aspect of this embodiment of the invention a pivot plate 34 is fitted between the facing longitudinal flat surfaces 4 of the half-round supports 2, with the brad shaft 31*a* extending through the pivot plate opening 34*a* in the pivot plate 34, to maintain the upper ends of the half-round supports 2 in secure, yet pivoting, relationship as illustrated in FIGS. 13 and 14. A bi-support camouflage 30, which includes camouflage netting 14, having a reinforced netting margin 15, is attached to the half-round supports 2 in a triangular configuration as illustrated in FIG. 14 and is shaped and sewn to define a netting sleeve 16 on each of the half-round supports 2, as illustrated in FIG. 16. Each netting sleeve 16 can be slidably adjusted upwardly or downwardly on the half-round supports 2, in order to conceal the hunter or observer in an optimum manner when the bi-support blind 29 is deployed as illustrated in FIG. 14, with the points 7 of the respective tapered ground-engaging end 6 of the half-round supports 2 extended into the ground or supporting surface. The securing strap 18 is used to secure the camouflage netting 14 of the bi-support camouflage 30 around the half-round supports 2 when the half-round supports 2 are longitudinally pivoted at the pivot pin or brad 31 and nested in aligned configuration, as illustrated in FIG. 13. The camouflage netting 14 is then wrapped around the nested half-round supports 2 as illustrated in FIG. 12. A tie string 22 may also be extended through a hole in one of the half-round supports 2 as illustrated in FIG. 14 and secured around the lower, or ground-engaging ends 6 of the half-round supports 2, under circumstances where the composite half-round supports 2 are used as a walking stick 23 when the bi-support camouflage 30 is removed.

It will be appreciated by those skilled in the art that the respective half-round supports 2, rectangular supports 8 and triangular supports 9 may be constructed of any desired material, including wood, fiberglass, metal or the like, depending upon weight and stiffness considerations and the desires of the manufacturer and user. Furthermore, either the securing strap 18 illustrated in FIG. 10 or FIG. 15 may be utilized in the respective centers of the camouflage netting 14 in the tri-support blind 1 and quad-support blind 25 to secure the respective camouflage netting 14 on the respective supports as illustrated in FIG. 1. Moreover, the camouflage netting 14 used in the tri-support blind 1, quad-support blind 25 and the bi-support blind 29 may be characterized by substantially any camouflage pattern (not illustrated) that may be desired by the user, and may include netting, solid fabric and other types of camouflage known to those skilled in the art. Specific patterns such as "TREBARK", "REAL-TREE" (trademarks) and other camouflage patterns known to those skilled in the art may be utilized.

While the preferred embodiments of the invention have been described above, it will recognized and understood that various modifications may be made in the invention and the appended claims are intended to cover all such modifications which may fall within the scope and spirit of the invention.

Having described my invention with the particularity set forth above, what is claimed is:

1. A combination walking stick and blind comprising at least two elongated supports and camouflage means attached to said supports, said supports longitudinally shaped to nest or fit together, said at least two elongated supports comprising a pair of longitudinal half-round supports, each of said half-round supports having a grip end and a ground-engaging end, said half-round supports each further comprising a flat longitudinal side and a round longitudinal side extending from said flat longitudinal side, whereby said half-round supports are aligned and nested with said flat longitudinal sides disposed in facing relationship with respect to each other, said camouflage means being wrapped around said half-round supports to define said walking stick in a first configuration, said half-round supports being separated from each other to deploy said camouflage means between said half-round supports to define said blind in a second configuration.

2. The combination walking stick and blind of claim 1 comprising fastening means attached to said camouflage means and said supports for securing said camouflage means to said supports.

3. The combination walking stick and blind of claim 1 wherein said camouflage means comprises a flexible camouflage netting and a camouflage pattern provided on said flexible camouflage netting.

4. The combination walking stick and blind of claim 1 wherein said camouflage means comprises a flexible camouflage netting and a camouflage pattern provided on said flexible camouflage netting and comprising fastening means attached to said flexible camouflage netting and said supports for slidably securing said flexible camouflage netting to said supports.

5. The combination walking stick and blind of claim 1 wherein each of said half-round supports comprise pin means extending through said half-round supports near said grip ends for pivotally joining said supports at said grip ends with said flat longitudinal sides facing one another.

6. The combination walking stick and blind of claim 5 comprising sleeve means provided in said camouflage means for slidably receiving said supports and adjustably securing said camouflage means to said supports.

7. The combination walking stick and blind of claim 5 wherein said camouflage means comprises a flexible camouflage netting and a camouflage pattern provided on said flexible camouflage netting.

8. The camouflage walking stick and blind of claim 5 wherein said camouflage means comprises a flexible camouflage netting and a camouflage pattern provided on said flexible camouflage netting and comprising sleeve means provided in said camouflage netting for slidably receiving said supports and adjustably securing said flexible camouflage netting to said supports.

9. The camouflage walking stick and blind of claim 8 comprising a loop-pile securing strap attached to said flexible camouflage netting for engaging and securing said flexible camouflage netting on said half-round supports when said half-round supports are pivoted together at said grip end and said flexible camouflage netting is wrapped around said half-round supports to define said walking stick in said first configuration.

10. The combination walking stick and blind of claim 1 wherein said at least two elongated supports comprise a plurality of elongated supports, each of said elongated supports having a grip end and a ground-engaging end.

11. The combination walking stick and blind comprising three elongated supports and camouflaged means attached to said supports, each of said supports longitudinally-shaped substantially in the configuration of a triangle, with one leg of said triangle rounded to define a curved outer surface of said supports and the remaining two legs of said triangle extending from opposite longitudinal parallel margins of said one leg to a common longitudinal edge, said supports thusly shaped to nest with said common longitudinal edge joined to define the longitudinal center of said walking stick and said curved outer surface substantially defining a circle when said supports are joined to define a walking stick in a first configuration, said supports separated to deploy said camouflage means between said supports and define said blind in a second configuration.

12. The combination walking stick and blind of claim 11 wherein said camouflage means comprises a flexible camouflage netting and a camouflage pattern provided on said flexible camouflage netting.

13. The combination walking stick and blind of claim 10 wherein said plurality of elongated supports comprises a first elongated support and a second elongated support, said first support and said second support each longitudinally shaped substantially in the configuration of a half-round support characterized by a flat longitudinal side and a round longitudinal side extending from said flat longitudinal side and a third support shaped to define a substantially rectangular cross-section, with said third support sandwiched between said first support and said second support in facing relationship with respect to said flat longitudinal side of said first support and said second support, said first support, said second support and said third support substantially defining an ellipse when said first segment, said second support and said third supports are joined to define a walking stick in said first configuration, said first support, said second support and said third support separated to deploy said camouflage means between said first support, said second support and said third support and define said blind in said second configuration.

14. The combination walking stick and blind of claim 10 wherein said plurality of elongated supports comprises four elongated supports, with a first pair of said supports each longitudinally shaped substantially in the configuration of a half-round support characterized by a flat longitudinal side and a round longitudinal side extending from said flat longitudinal side and the remaining pair of said supports each shaped to define a substantially rectangular cross-section, with said remaining pair of said supports sandwiched between said first pair of said supports with said flat longitudinal side of each of said first pair of said supports facing a different one of said remaining pair of said supports, said supports substantially defining an ellipse when said supports are joined to define a walking stick in said first configuration, said supports separated to deploy said camouflage means between said supports and define said blind in said second configuration.

15. The combination walking stick and blind of claim 14 wherein said remaining pair of said elongated supports are disposed between said first pair of said supports with a narrow side of said rectangular cross-section, respectively, facing said flat longitudinal side of said first pair of supports, respectively.

16. The combination walking stick and blind of claim 14 wherein said remaining pair of said elongated supports are disposed between said first pair of said supports with a longest side of said a rectangular cross-section, respectively, facing said flat longitudinal side of said first pair of supports, respectively.

17. The combination walking stick and blind comprising four elongated longitudinal quarter-round supports and camouflage means attached to said supports, each of said quarter-round supports longitudinally-shaped substantially in the configuration of a triangle, with one longitudinal leg of said triangle rounded to define a curved outer surface of said supports and the remaining two legs of said triangle extending from opposite margins of said one leg to a common longitudinal edge, said supports thusly shaped to nest with said common edge longitudinally joined to define in the longitudinal center of said walking stick and said curved outer surface substantially defining a circle when said supports are joined to define a walking stick in first configuration, said supports separated to deploy said camouflage means between said supports and define said blind in second configuration.

18. A combination walking stick and blind comprising a pair of elongated supports and flexible camouflage material slidably attached to said supports, each of said supports having a grip end and a ground-engaging end and longitudinally shaped to define a half-round cross-section defined by a flat longitudinal side and a rounded longitudinal side, wherein said flat longitudinal side of each of said supports is disposed in facing relationship with respect to each other and said rounded longitudinal side defines a substantially circular cross-section when said supports are joined, and further comprising pin means joining said grip ends of said supports, whereby said supports are selectively pivoted on said pin means into longitudinal alignment and said flexible camouflage material is wrapped around said supports to define a walking stick in a first configuration and said supports are pivoted on said pin means out of alignment, with said ground-engaging end spaced from each other and said flexible camouflage material stretched between said supports to define a blind, in a second configuration.

19. A combination walking stick and blind comprising a first elongated support, a second elongated support and a third elongated support each having a grip end and a ground-engaging end and flexible camouflage material slidably attached to said first support, said second support and said third support, said first support and said second support longitudinally shaped into half-round cross-section defined by a flat longitudinal side an a rounded longitudinal side and said third support having a rectangular cross-sectional configuration, wherein said flat longitudinal side of said first support and said second support, respectively is disposed in facing relationship with respect to said third support, thus defining a substantially elliptical cross-section when said first support, said second support and said third support are joined, whereby said first support, said second support and said third support are selectively nested in longitudinal alignment and said flexible camouflage material is wrapped around said first support, said second support and said third support to define a walking stick in a first configuration and said first support, said second support and said third support are separated and said flexible camouflage material stretched between said first support, said second support and said third support to define a blind in a second configuration.

20. A combination walking stick and blind comprising four elongated supports having a grip end and a ground-engaging end and flexible camouflage material slidably attached to said supports, a first pair of said supports longitudinally shaped to define a half-round cross-section defined by a flat longitudinal side and a rounded longitudinal side and a second pair of said supports each having a rectangular cross-sectional configuration, wherein said flat longitudinal side of each of said first pair of said supports is disposed in facing relationship with respect to said second pair of said supports, thus defining a substantially elliptical cross-section when said supports are joined, whereby said supports are selectively nested in longitudinal alignment and said flexible camouflage material is wrapped around said supports to define a walking stick in a first configuration and said supports are separated and said flexible camouflage material stretched between said supports to define a blind in a second configuration.

* * * * *